United States Patent [19]

Tanaka

[11] 4,128,114

[45] Dec. 5, 1978

[54] YARN WASTE REMOVING MEANS FOR AIR JET WEAVING LOOM

[75] Inventor: Shigenori Tanaka, Hachioji, Japan

[73] Assignee: Nissan Motor Company, Limited, Japan

[21] Appl. No.: 836,957

[22] Filed: Sep. 27, 1977

[30] Foreign Application Priority Data

Dec. 17, 1976 [JP] Japan ..... 51-50734

[51] Int. Cl.[2] ..... D03D 47/30

[52] U.S. Cl. ..... 139/435; 139/1 C; 139/429; 112/DIG. 3; 112/254

[58] Field of Search ..... 139/194, 429, 435, 450, 139/452, 1 C; 112/DIG. 3, 254, 255; 242/150

[56] References Cited

U.S. PATENT DOCUMENTS

| | | | |
|---|---|---|---|
| 2,158,197 | 5/1939 | Pikul | 112/255 |
| 2,646,944 | 7/1953 | Heffelfinger | 242/150 |
| 3,542,595 | 11/1970 | McCullough et al. | 139/1 C |

*Primary Examiner*—Henry S. Jaudon

*Attorney, Agent, or Firm*—Robert E. Burns; Emmanuel J. Lobato; Bruce L. Adams

[57] ABSTRACT

An air passage is formed in the weft yarn grasping means to permit the passage of air therethrough upon weft yarn releasing action of the grasping means, so that any yarn waste and miscellanea gathering in the grasping means are removed by the passing air.

7 Claims, 5 Drawing Figures

YARN WASTE REMOVING MEANS FOR AIR JET WEAVING LOOM

BACKGROUND OF THE INVENTION

The present invention relates in general to an air jet weaving loom and more particularly to a yarn waste removing apparatus provided in the loom. More specifically, the present invention is concerned with such removing apparatus which is particularly used for removing the yarn waste and miscellanea gathering in the vicinity of so called weft yarn grasping means during the weaving operation of the loom.

In an air jet weaving loom, it is usually observed that the stamping operation of the weft yarn grasping means, comprising, for example, stationary and movable discs by which a weft yarn is intermittently grasped, causes a production of fair amounts of yarn waste or miscellanea. Some of these contaminants are deposited on the contacting surfaces of these stationary and movable discs of the grasping means thus causing a poor function of the grasping means. In addition, the waste and the miscellanea thus deposited on the surface of the weft yarn moving toward the yarn shooting nozzle will cause a blockage of the yarn in the nozzle.

One of the methods to remove such yarn waste and miscellanea is disclosed in Japan utility model application serial No. 51-94870 in which an air blower is arranged to blow off the waste from the transverse direction of weft yarn grasping means, the grasping means including a stationary disc and a movable disc which is connected to an actuator via a reciprocating rod passing through a central opening formed in the stationary disc. However, in this disclosed method, there is always produced behind the reciprocating rod, with respect to the air blower, an air stagnant portion where the yarn waste is very collectable with a result that the normal function of the grasping means is not achieved.

SUMMARY OF THE INVENTION

Therefore, the present invention is proposed to eliminate the above-mentioned drawbacks of the conventional air jet weaving loom.

It is an object of the present invention to provide an air jet weaving loom which has an improved yarn waste removing means constructed to remove yarn waste and/or miscellanea gathering in the vicinity of the weft yarn grasping means during the weaving operation of the loom.

It is another object of the present invention to provide an improved yarn waste removing apparatus which can be constructed in a simple and economical manner.

According to the present invention, there is provided an air jet weaving loom, comprising: weft yarn grasping means including stationary and movable members which are contactable with each other to grasp a weft yarn, and a rod member which slidably passes through a passage hole formed in the stationary member to connect at its head portion to the movable member; actuating means for axially reciprocating the rod member to move the movable member reciprocatively relative to said stationary member for allowing the grasping means to alternately grasp and release the weft yarn; and yarn waste removing means including at least one pasage which is defined between the rod member and the stationary member so as to extend along the axis of the rod member, the passage having an end open to a clearance defined between the movable and stationary members adjacent the rod member and the other end connecting to an air pump, whereby when the movable member is separated from the stationary member to form the clearance in response to the operation of the actuating means, a stream of air flowing through the air passage is formed to remove any yarn waste and miscellanea gathering in the clearance.

BRIEF DESCRIPTION OF THE DRAWINGS

Other objects and advantages of the present invention will become apparent from the following description when taken in conjunction with the accompanying drawings, in which.

DESCRIPTION OF THE PREFERRED EMBODIMENTS

Figure 1:
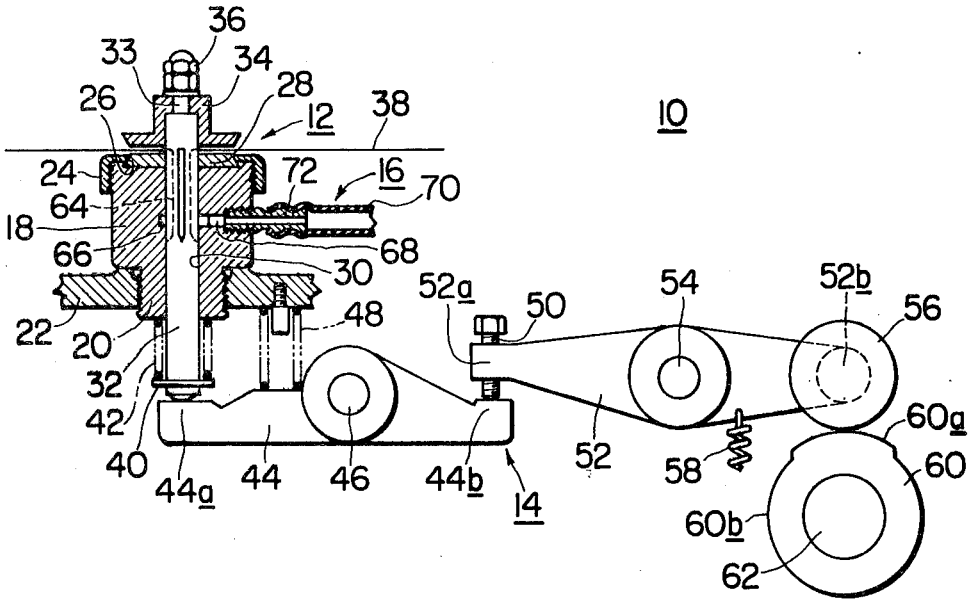
FIG. 1 is a sectional view of a unit of a weft yarn grasping means and an actuating means, showing the grasping means cooperating with a yarn waste removing means of a first preferred embodiment of the present invention.
Figure 2:
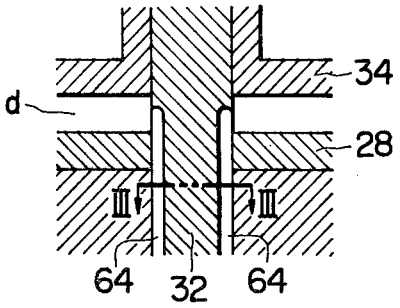
FIG. 2 is an enlarged sectional view showing an important portion of the yarn waste removing means shown in FIG. 1.
Figure 3:
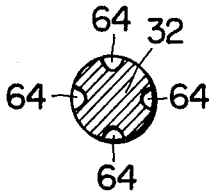
FIG. 3 is a sectional view taken along the line III—III of FIG. 2.

Referring to FIGS. 1 to 3, particularly to FIG. 1, there is illustrated in a sectional manner a unit 10 consisting of a weft yarn grasping means 12, an actuating means 14 for the grasping means 12, and a yarn waste removing means 16 cooperating with the grasping means 12, the yarn waste removing means 16 forming a main part in the subject invention.

The weft yarn grasping means 12 comprises a cylindrical base member 18 which has at its lower section an extension 20 threaded in an opening (no numeral) formed in a frame member 22 of the loom 10 and at its upper section an exteriorly threaded portion (no numeral). Screwed and fixed to the threaded portion is a holding ring 24 which has a central opening 26 through which a stationary disc 28 is tightly attached on an upper portion of the base member 18. The stationary disc 28 and the base member 18 are respectively formed with a central opening (no numeral) and a central hole 30 which are vertically aligned to slidably receive therein a reciprocating rod 32. The rod 32 is provided at its upper end, projected from the stationary disc 28, with a cup-shaped disc 34 via a connecting nut 36 screwed to a threaded extension 33 of the rod 32. Hereinafter, the cup-shaped disc 34 will be designated by a movable disc for facilitation of the description. The movable disc 34 has a lower flat surface portion (no numeral) which is wholly contactable with an upper flat surface portion (no numeral) of the stationary disc 28 when a grasping action to a weft yarn 38 takes place in the grasping means 12. As shown, the rod 32 is equipped at its lower end section, projected from the base member extension 20, with a spring retainer 40 for disposing a spring 42 between it and the extension 20 to urge the reciprocating rod 32 downwardly, that is in a direction to move the movable disc 34 toward the stationary disc 28.

The actuating means 14 functions to intermittently push upwardly the rod 32 and thus the movable disc 34 to release the weft yarn 38 from the grasping means 12. This pushing action is carried in response to the picking action of the loom. The actuating means 14 comprises a first lever 44 which is pivotablly supported at its fulcrum 46 and has a left end 44*a* contactable with a convex surface formed on the downwardly extending end of the reciprocating rod 32. Normally, the lever 44 is biased to rotate in a counterclockwise direction by the action of a spring 48 disposed between it and the frame member 22. This counterclockwise rotation of the first lever 44 is limited by the right end 44*b* thereof contacting an adjusting screw 50 fixed to a second lever 52. As shown, the second lever 52 is pivotally supported at its fulcrum 54 and has a left end 52*a* to which the adjusting screw 50 is fixed and a right end 52*b* to which a cam follower 56 is rotatably fixed. A tension spring 58 is fixed to the second lever 52 for biasing the same to rotate in a clockwise direction forcing the cam follower 56 to operatively engage a cam 60 fixedly disposed about an axis 62. The axis 62 is arranged to rotate one time per one picking action of the loom 10. With this, when the cam follower 56 rises on a projected section 60*a* of the cam 60, as illustrated, the second lever 52 takes a position to allow the first lever 44 to push upwardly the reciprocating rod 32 and thus the movable disc 34 to release the weft yarn 38 from the grasping means 12, while when the cam follower 56 slides on a non-projected section 60*b* of the cam 60, the second lever 52 takes the other position to allow the first lever 44 to slightly rotate in a counterclockwise direction by the action of the spring 48 allowing the reciprocating rod 32 and thus the movable disc 34 to move toward or return to its home position by the action of the spring 42 to grasp the weft yarn 38.

The yarn waste removing means 16 is solidly incorporated with the grasping means 12 as will be described hereinnext. The removing means 16 comprises four parallel grooves 64 equidistantly formed in the recirprocating rod 32 and an annular groove 66 formed in the cylindrical wall bounding the before-mentioned central hole 30 of the cylindrical base member 18. The annular groove 66 is arranged to always open to the four parallel grooves 64. However, as will be understood from FIG. 2, the four parallel grooves 64 in the rod 32 are arranged so that upwardly leading ends thereof are positioned slightly below the lower flat surface portion of the movable disc 34 allowing the parallel grooves 64 to communicate with a clearance (d) formed between the movable disc 34 and the stationary disc 28 when separation of the movable disc 34 from the stationary disc 28 takes place. The annular groove 66 is merged with a passage 68 also formed in the cylindrical base member 18 to which passage 68 a tube 70 is connected through a connector 72. Although not shown in the drawings, the tube 70 is connected to an air supply pump by which a compressed air stream flowing through the tube 70 toward the four parallel grooves 64 is formed upon a state that the grooves 64 open to the clearance (d).

During the weaving operation of the loom, the grasping means 12 alternately grasps and release the weft yarn 38 in response to the swingable operation of the actuating means 14, thus inducing conditions wherein the four parallel grooves 64 communicate with the clearance (d). Under these conditions, there is produced a stream of compressed air flowing from the air supply pump toward the clearance (d) as has been described before. By the stream, any yarn waste and other miscellanea collected or gathered in the clearance (d) are blown off. The yarn waste scavenging operation of the removing means 16 thus occurs one time per one picking action of the loom.

Figure 4:
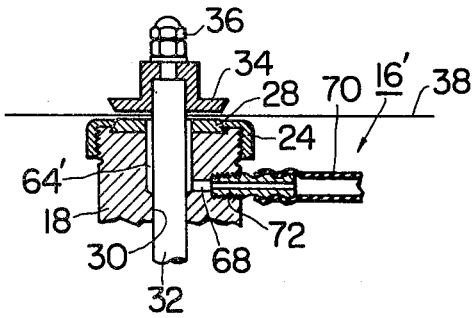
FIG. 4 is a sectional view of a weft yarn grasping means cooperating with a yarn waste removing means of a second preferred embodiment according to the present invention.

Referring to FIG. 4, there is shown a second preferred embodiment of a yarn waste removing means of the subject invention, which is designated by numeral 16'. Similar parts are denoted by the same numerals as in the case of the first embodiment of FIG. 1. In this second embodiment, a cylindrical recess 64' is provided, in place of the four parallel grooves 64 of the first embodiment, by forming a larger diameter portion (no numeral) in the central hole 30 of the base member 18 and enlarging the central opening of the stationary disc 34. The yarn waste scavenging operation is also carried out in this case when the movable disc 34 is separated from the stationary disc 28.

Figure 5:
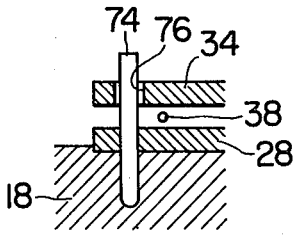
FIG. 5 is a partial and sectional view of a weft yarn retaining means cooperating with the weft yarn grasping means shown in FIGS. 1 and 4.

Referring to FIG. 5, there is shown a weft yarn retaining device 74 cooperating with the weft yarn grasping means 12. The device 74 is a pin having an upper section spacedly received in an opening 76 formed in the movable disc 34, and a lower section passing through an opening (no numeral) of the stationary disc 28 fixed to the cylindrical base member 18. As shown in the drawing, the pin is located at a position near the lateral edges of the movable and stationary discs 34 and 28, so that the desired passage way for the travelling weft yarn 38 is defined between the pin and the reciprocating rod 32 (not shown in this drawing). By the pin, the weft yarn 38 can be held in the desired passage way thereof even if a compressed air from the passages 64 (or the recess 64') is applied to the weft yarn to blow off the same.

In addition to the above, the following modifications are available in the invention.

An air suction pump may be used, in place of the air supply pump, for forming a stream of air flowing from the clearance (d) toward the tube 70 through the four parallel passages 64 (or the cylindrical recess 64'). In this case, it is desired to mount an air filter upstream of the pump.

Furthermore, if desired, both the air supply pump and the air suction pump may be employed in the yarn waste removing means of the invention in such an arrangement that these pumps are independently connected to the tube 70 through a common switching valve which can alternately provide a fluid connection between the tube 70 and the air supply pump or between the tube 70 and the air suction pump. In this modification, it is necessary to fix a wet type air filter to a conduit section located between the valve and the air suction pump. With this arrangement inducing a reciprocating air flow in the clearance (d), the yarn waste and the miscellanea gathering in the grasping means 12 are more effectively removed.

What is claimed is:

1. An air jet weaving loom, comprising:

weft yarn grasping means including stationary and movable members which are contactable with each other to grasp a weft yarn, and a rod member which slidably passes through a hole in said stationary member and connects at its head portion to said movable member;

actuating means for axially reciprocating said rod member to move said movable member reciprocatively relative to said stationary member for allowing said grasping means to alternately grasp and release said weft yarn; and yarn waste removing means including at least one passage which is defined between said rod member and said stationary member so as to extend along the axis of said rod member, said passage having an end open to a clearance defined between said movable and stationary members adjacent said rod member and the other end connecting to an air pump, whereby when said movable member is separated from said stationary member to form said clearance in response to the operation of said actuating means, a stream of air flowing through said passage is formed to remove any yarn waste and miscellanea gathering in said clearance.

2. An air jet weaving loom as claimed in claim 1, in which said passage of said yarn waste removing means is at least one groove longitudinally formed in said rod member of said grasping means.

3. An air jet weaving loom as claimed in claim 1, in which said passage of said yarn waste removing means is a recess formed in an inside wall surface of said stationary member, said inside wall surface bounding said hole through which said rod member is slidably held.

4. An air jet weaving loom as claimed in claim 1, further comprising a pin member having an upper section thereof spacedly received in an opening formed in said movable disc and a lower section thereof fixed to said stationary member.

5. An air jet weaving loom, comprising:

weft yarn grasping means including stationary and movable members which are contactable with each other to grasp a weft yarn, and a rod member which slidably passes through a hole formed in said stationary member and connects at its head portion to said movable member;

actuating means for axially reciprocating said rod member to move said movable member reciprocatively for allowing said grasping means to alternately grasp and release said weft yarn; and yarn waste removing means including an air passage formed in said grasping means, said air passage having an end thereof fluidly communicable to a clearance defined between said movable and stationary members and the other end thereof fluidly connected to an air pump, said air passage of said yarn waste removing means comprising at least one groove longitudinally formed in said rod member of said grasping means, whereby when said movable member is separated from said stationary member to form said clearance in response to the operation of said actuating means, a stream of air flowing through said passage is formed to remove any yarn waste and miscellanea gathering in said clearance.

6. An air jet weaving loom, comprising:

weft yarn grasping means including stationary and movable members which are contactable with each other to grasp a hole formed in said stationary member and connects at its head portion to said movable member;

actuating means for axially reciprocating said rod member to move said movable member reciprocatively for allowing said grasping means to alternately grasp and release said weft yarn; and yarn waste removing means including an air passage formed in said grasping means, said air passage having an end thereof fluidly communicable to a clearance defined between said movable and stationary members and the other end thereof fluidly connected to an air pump, said air passage of said yarn waste removing means comprising a recess formed in an inside wall surface of said stationary member, said inside wall surface bounding the hole through which said rod member is slidably held, whereby when said movable member is separated from said stationary member to form said clearance in response to the operation of said actuating means, a stream of air flowing through said passage is formed to remove any yarn waste and miscellanea gathering in said clearance.

7. An air jet weaving loom, comprising:

weft yarn grasping means including stationary and movable members which are contactable with each other to grasp a weft yarn, and a rod member which slidably passes through a hole formed in said stationary member and connects at its head portion to said movable member;

actuating means for axially reciprocating said rod member to move said movable member reciprocatively for allowing said grasping means to alternately grasp and release said weft yarn;

yarn removing means including an air passage formed in said grasping means, said air passage having an end thereof fluidly communicable to a clearance defined between said movable and stationary members and the other end thereof fluidly connected to an air pump; and a pin member having an upper section thereof spacedly received in an opening formed in said movable disc and a lower section thereof fixed to said stationary member.

* * * * *